United States Patent [19]

Absenger

[11] Patent Number: 5,033,578

[45] Date of Patent: Jul. 23, 1991

[54] INTERNAL COMBUSTION ENGINE HAVING A SOUND-PROOFING CASING

[75] Inventor: Erich Absenger, Passau, Fed. Rep. of Germany

[73] Assignee: Motorenfabrik Hatz GmbH & Co. KG, Ruhstorf, Fed. Rep. of Germany

[21] Appl. No.: 488,748

[22] Filed: Mar. 2, 1990

[30] Foreign Application Priority Data

Mar. 4, 1989 [DE] Fed. Rep. of Germany ..... 3907083

[51] Int. Cl.[5] ..... F01P 1/02; F02B 77/11

[52] U.S. Cl. ..... 181/204; 123/41.7; 123/198 E

[58] Field of Search ..... 181/204; 123/198 C, 123/198 E, 41.7

[56] References Cited

U.S. PATENT DOCUMENTS

| | | | |
|---|---|---|---|
| 3,666,042 | 5/1972 | Cederbaum | 181/204 |
| 4,011,849 | 3/1977 | Latham | 123/198 E |
| 4,122,353 | 10/1978 | Noguchi | 181/204 X |
| 4,341,187 | 7/1982 | Absenger | 123/198 E |
| 4,385,678 | 5/1983 | Cederbaum | 181/204 |

*Primary Examiner*—Benjamin R. Fuller
*Assistant Examiner*—David Yockey
*Attorney, Agent, or Firm*—Flynn, Thiel, Boutell & Tanis

[57] ABSTRACT

An internal combustion engine includes a sound-proofing casing, and a silencer arranged in a separate chamber within the casing such that it does not touch the walls of the separate chamber. Fresh cooling air passes through an inlet opening from the interior of said casing into the separate chamber, and spent cooling air from said separate chamber passes back into the air flowing within the casing, whereby all of the spent air flows from the interior of the sound-proofing casing through an outlet opening of said casing to the outside.

4 Claims, 2 Drawing Sheets

INTERNAL COMBUSTION ENGINE HAVING A SOUND-PROOFING CASING

FIELD OF THE INVENTION

The invention relates to an internal combustion engine having a casing which completely surrounds the engine housing for the purpose of sound-proofing, which casing comprises a plurality of elements coupled to one another and which is carried by the engine housing with the interposition of shock-absorbing means, wherein a blower sucks in fresh cooling air through an inlet opening in the casing, conveys it through the interior between the engine housing and the casing and blows out the spent air through an outlet opening in the casing.

BACKGROUND OF THE INVENTION

It is an object of the invention to dispose the exhaust gas silencer of the engine in its flow of cooling air in such a way that optimum cooling is achieved whilst, at the same time ensuring that the outer wall of the casing has a smooth design.

It is a further object of the invention, once the engine has been switched off and hence the flow of cooling air has been interrupted, to prevent too much radiant heat from being emitted by the exhaust gas silencer, which is still hot, into its surroundings.

SUMMARY OF THE INVENTION

In accordance with the invention, a special or separate chamber formed inside the casing, is separated from the casing interior by intermediate walls and surrounds the exhaust gas silencer, which is fastened to the engine housing, in such a way that there is no contact between the silencer and the walls forming the separate chamber, and an opening provided in an intermediate wall of the separate chamber in the region of the flow of fresh cooling air allows the cooling air to flow from the interior of the casing into the separate chamber, while a further opening provided in or between the intermediate walls allows spent air from the separate chamber to pass out into the flow of hot or spent air flowing within the casing itself, whereby all of the spent air flows from the interior of the sound-proofing casing through the outlet opening of said casing to the outside.

In order to prevent radiant heat escape from the separate chamber, in a suitable embodiment of the invention, each wall forming the separate chamber is provided in full or in part with a heat-insulating layer on its side facing the silencer.

In a further embodiment of the invention, an additional casing inside the separate chamber completely surrounds the silencer and prevents an undesired amount of radiant heat from being emitted by the silencer into its surroundings inside the separate chamber.

BRIEF DESCRIPTION OF THE DRAWINGS

The invention is further described, by way of example, with reference to the accompanying drawings, in which.

DETAILED DESCRIPTION

Figure 1:
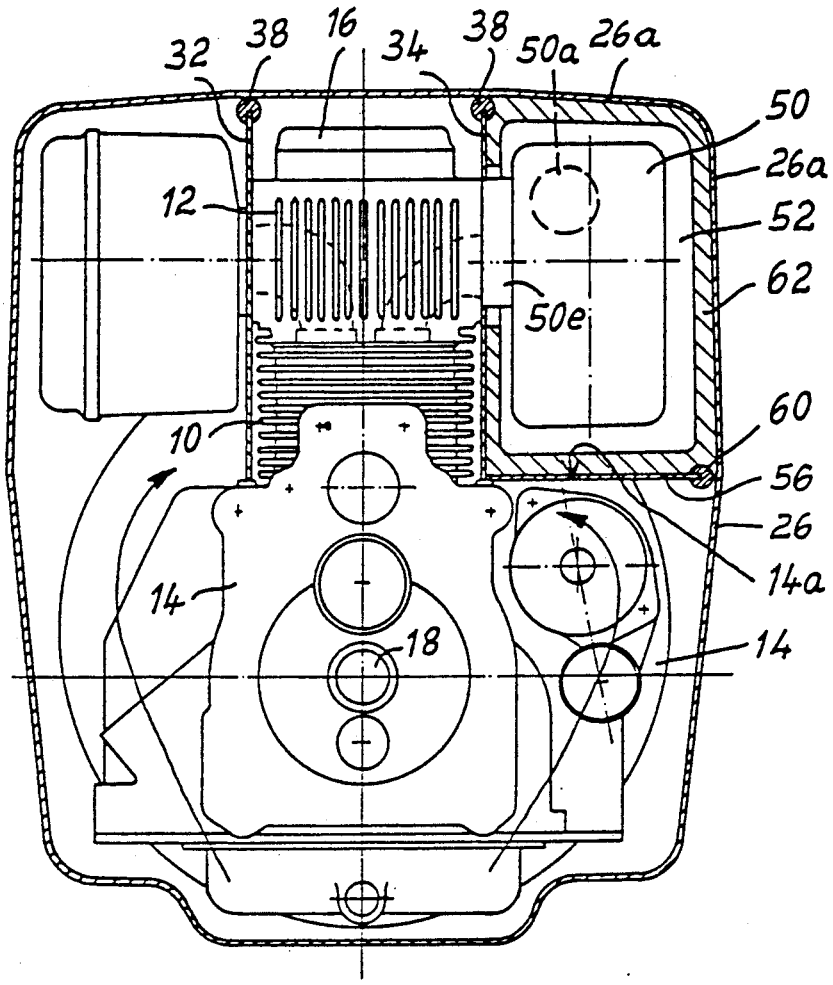
FIGS. 1 and 2 are respectively front and plan views of a first embodiment of an internal combustion engine according to the invention, with the sound-proofing casing in section.

The construction of the internal combustion engine shown is the same as that of the single-cylinder engine described in my U.S. patent application Ser. No. 07/406 709, filed Sept. 13, 1989. The engine comprises a cylinder 10 and a cylinder head 12, which are clamped together in a known way with the crank housing 14 to form an engine block. The cylinder head 12 carries a cover 16 which covers off the space for the valve rocker at the top. The end of the crankshaft 18, which is horizontally mounted in the crank housing 14, carries, in a known manner, a cooling air blower 20. The blower 20 also acts as a flywheel.

In order to damp the noise radiated by the engine during operation, a multiple-element casing is provided which completely surrounds the engine housing. It comprises a shell 22, which is disposed on the flywheel or blower side, a shell 24, which is disposed on the control side, and a shell 26, which encircles the engine. These casing elements are in the form of sheet-metal parts having thin walls. The shell 26 is fastened to the engine housing with the aid of two support plates 32 and 34 of squared or quadratic form and provided on their periphery with shock-absorbing means 38 and 39 in the form of round cross-section strips. Absorbing means 38 are interposed between shell 26 and said plates 32 and 34, and absorbing means 39 are interposed between the shell 22 and said plates 32 and 34. The other shells 22, 24 are connected, for example screwed, to the shell 26 in a conventional way (not shown).

The shell 24 is a one-piece element and is provided with two lateral openings **24*a* and 24*e*. A two-part, sound-absorbing layer 44, which may, for example, be made of rock wool, is applied to the inside of this shell 24 in such a way that two separate channels 44*e*, 44*a* are formed in the layer. The closed channel 44*e*starts from the opening 24*e*, then extends downwards substantially in the direction of the cylinder axis, and then opens laterally at the base region of the casing. The channel 44*a*, which is also enclosed, extends substantially horizontally and issues at the opening 24*a*. A lateral hole 44*af* connects the channel 44*a* to the interior of the casing. The two channels 44*e*, 44*a*** are thus completely separated from one another, although they both open towards the interior of the casing.

The blower 20 sucks in the fresh air through the channel **44*e* and the inlet opening 24*e* into the lower interior of the casing and conveys it upwards along the outer surfaces of the engine, as shown by the arrows in FIG. 1. The exhaust air passes through the opening 44*af* out of the inside of the casing into the channel 44*a*, and then to the outlet opening 24*a***, through which it leaves the casing.

An exhaust gas silencer or muffler 50 of a known type is disposed inside the casing and is fastened by its inlet piece **50*e* to the cylinder head 12. The engine exhaust gases, which pass through the silencer, then pass through its outlet piece 50*a* to the outside, wherein the piece 50*a* projects through an opening in the shell 22 at the flywheel side. Conventional means (not shown) of the type described in U.S. Pat. No. 4 341 187 are provided in the annular gap between the outlet piece 50*a* and the shell 22** and prevent cooling air or noise from reaching the outside.

The exhaust gas silencer 50 is disposed in a separate chamber 52 inside the casing. The separate chamber 52 is defined with respect to the exterior by a portion **26*a*** of the shell 26 and a portion 22*a* of the shell 22. It is defined with respect to the interior by the lateral plate 34, a further side plate 54 and a base plate 56. All plates 32, 34, 54, 56 are separate and plane elements fabricated in the form of squared or quadratic sheet-metal elements and provided with necessary passages or opening (discussed below). The plate 54 is fastened (for example by adhesive substances) to the plane front side 44*f* of the layer 44 in the shell 24. The plate 56 is fastened in similar manner on the plane face 14*a* of the plane upper side projection of the housing 14. In the mounted position of said elements appropriate shock-absorbing means 58 and 60 in the form of round cross-section strips are interposed between the shell 26 and the plates 54 and 56. The insides of the separate chamber 52 are provided with a multiple-part, heat-insulating layer 62 in order to prevent an undesirably high degree of heat radition from the silencer 50 both towards the interior as well as towards the exterior. The silencer 50 does not touch the walls of the separate chamber 52 or the insulating layers 62.

The separate chamber 52 is included in the flow of fresh blower cooling air in that some of this cooling air can flow through an inlet opening 64 into the separate chamber 52, where it cools the silencer 50. The spent or hot air then leaves the separate chamber 52 through an outlet opening 66 in the direction of the opening 44*af* in the shell 24 and passes with the remainer of the spent or hot air from the inside of the casing through the outlet opening 24*a* into the atmosphere.

By arranging the exhaust gas silencer in a separate chamber inside the casing and connecting this separate chamber to the cooling air flowing through the casing, effective cooling of the silencer is achieved. Applying an insulating layer 62 to the insides of the separate chamber 52 also prevents undesired heat radiation at all sides.

The advantageous arrangement of the silencer 50 inside the separate chamber 52 of the casing enables the casing to have a smooth design, so that the entire casing can have a closed external form.

Figure 2:
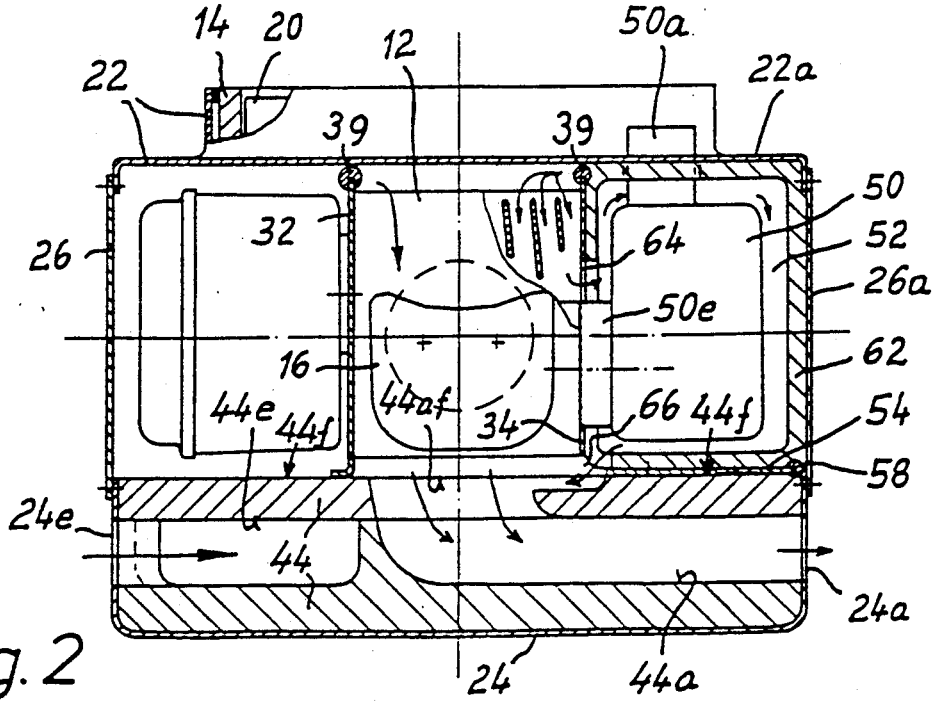

As illustrated in FIG. 2, the exhaust gas silencer 50 is arranged extremely closely adjacent the outlet opening 66. A line 90 is shown extending from the approximate geometric center C of the silencer 50 to the opening 66. This line 90 includes a point B on the outer peripheral surface of the silencer 50. It is clear from FIG. 2 that the linear distance from point C to point B is greater than 50% of the linear distance from point C to the opening 66.

Figure 3:
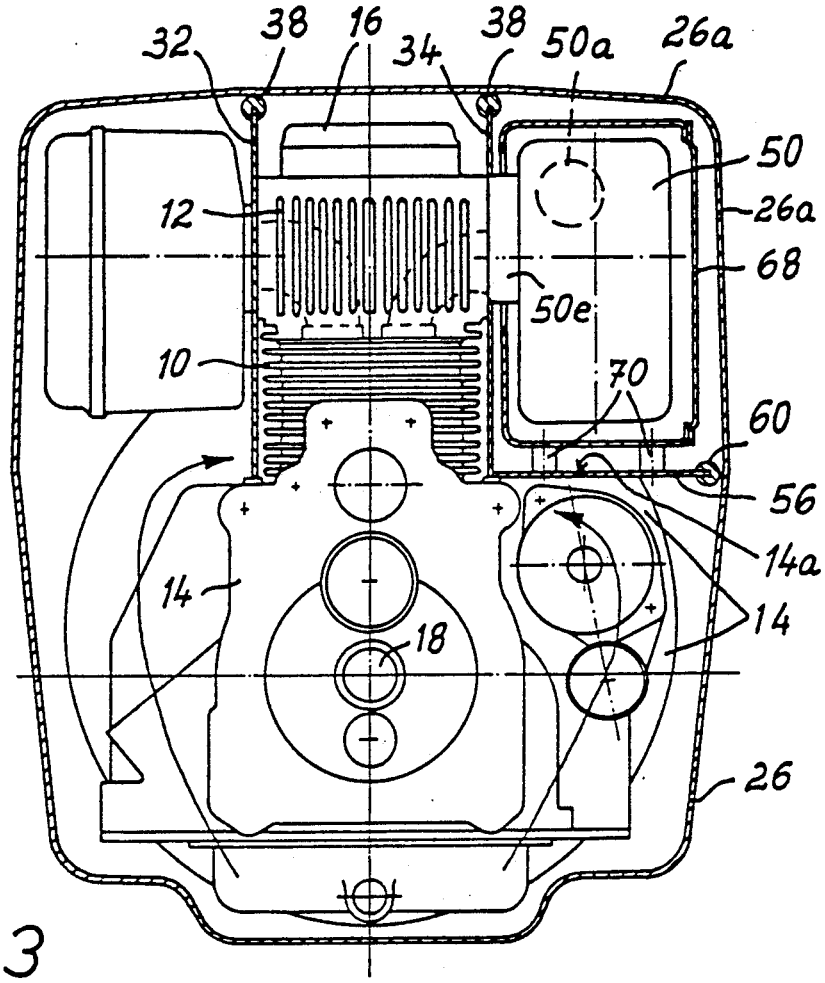
FIGS. 3 and 4 are similar front and plan views of a second embodiment of the invention.
Figure 4:
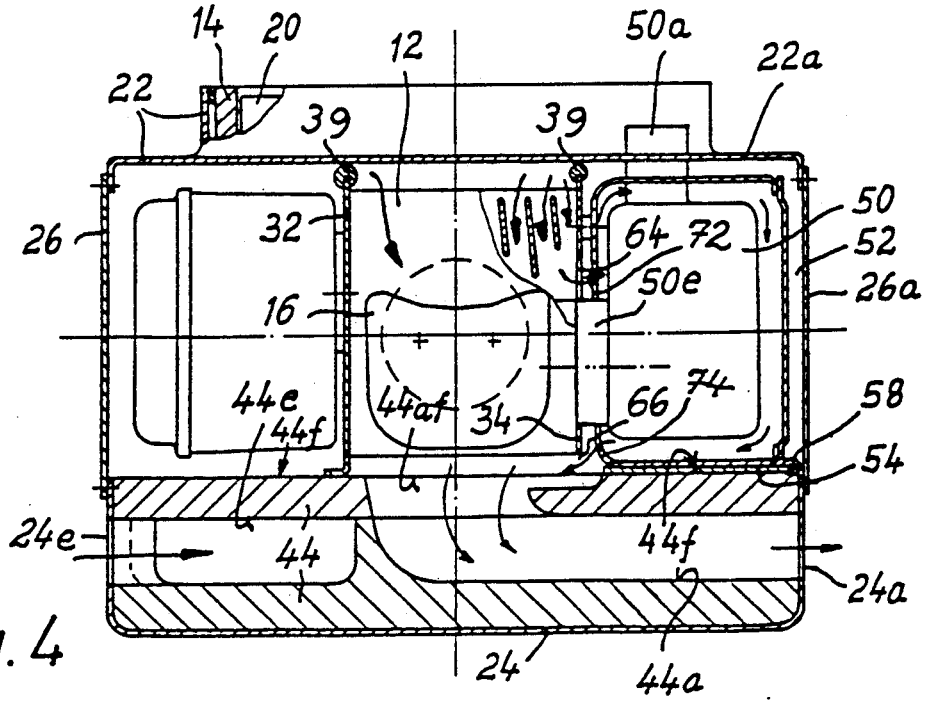

In the embodiment in FIGS. 3 and 4, wherein like parts are denoted by like reference numerals, the exhaust gas silencer 50 is disposed in the same way as in the first embodiment, namely, in the separate chamber 52 inside the casing 22,24,26. However, in place of the heat-insulating layer on the insides of the separate chamber 52, in this case a multiple-element additional casing 68 is provided, which completely surrounds the exhaust gas silencer 52. The additional casing is fastened to the base wall 56 using holders 70 and is thus supported by the crank housing 14,14*a*. The silencer 50 does not touch the walls of the additional casing 68. Furthermore, the inlet opening 64 of the separate chamber 52 communicates with an inlet opening 72 of the additional casing 68, and the outlet opening 66 of said separate chamber 52 communicates with an outlet opening 74 in the additional casing 68. In this embodiment again, the use of the additional casing 68 prevents an undesired amount of radiant heat from being emitted by the exhaust gas silencer into its surroundings.

Although a particular preferred embodiment of the invention has been disclosed in detail for illustrative purposes, it will be recognized that various or modifications of the disclosed apparatus, including the rearrangement of parts, lie within the scope of the present invention.

The embodiments of the invention in which an exclusive property or privilege is claimed are defined as follows:

1. An internal combustion engine having an engine housing and a sound proofing casing which completely surrounds said engine housing, which casing comprises a plurality of elements coupled to one another and is carried on said engine housing by shock-absorbing means interposed between said engine housing and said casing and defining a space therebetween, respective inlet and outlet openings defined in said casing, a blower for drawing in fresh cooling air through said inlet opening in said casing, conveying said cooling air through said space between said engine housing and said casing and blowing out said cooling air through said outlet opening in said casing, a separate chamber is provided in said space between said engine housing and said casing, an exhaust gas silencer oriented entirely within and surrounded by said separate chamber and fastened to said engine housing in such a way that there is no mechanical contact between said silencer and said separate chamber, said separate chamber including intermediate walls disposed between said silencer and said engine housing, an opening, provided in at least one of said intermediate walls adjacent said flow of cooling air through said casing for allowing said cooling air to flow from said space between said engine housing and said casing into said separate chamber to cool said exhaust gas silencer, a further opening separate from said outlet opening is provided in at least one of said intermediate walls for allowing said cooling air to flow out from said separate chamber back into said space between said engine housing and said casing at a same or closely adjacent location whereat said cooling air from cooling said engine enters said outlet opening to thereby permit all of said cooling air to flow outwardly through said outlet opening of said casing, said exhaust gas silencer having an outer peripheral surface which has a corresponding geometeric center point, said further opening being linearly spaced from a point on said outer peripheral surface by a first linear distance along a line defined by said point and said geometric center point, said point and said geometric center point being spaced from each other along said line by a second distance, a ratio of said second distance to said first distance being greater than 50%.

2. The internal combustion engine as claimed in claim 1, in which a portion of said separate chamber which faces said exhaust gas silencer has provided thereon in full or in part a heat-insulating layer.

3. The internal combustion engine as claimed in claim 1, in which an additional casing is provided inside said separate chamber, said additional casing completely surrounding said silencer to prevent an undesired amount of radiant heat from being emitted by said silencer outwardly beyond said additional casing into a part of said separate chamber defined outside of said additional casing.

4. An internal combustion engine having an engine housing and a sound proofing casing which completely surrounds said engine housing, which casing comprises a plurality of elements coupled to one another and is carried on said engine housing by shock-absorbing means interposed between said engine housing and said casing and defining a space therebetween, respective inlet and outlet openings defined in said casing, a blower for drawing in fresh cooling air through said inlet opening in said casing, conveying said cooling air through said space between said engine housing and said casing and blowing out said cooling air through said outlet opening in said casing, a separate chamber provided in said space between said engine housing and said casing, an exhaust gas silencer oriented entirely within and surrounded by said separate chamber and fastened to said engine housing in such a way that there is no mechanical contact between said silencer and said separate chamber, said separate chamber including intermediate walls disposed between said silencer and said engine housing, an opening provided in at least one of said intermediate walls adjacent said flow of cooling air through said casing for allowing said cooling air to flow from said space between said engine housing and said casing into said separate chamber to cool said exhaust gas silencer, a further opening separate from said outlet opening provided in at least one of said intermediate walls for allowing said cooling air to flow out from said separate chamber back into said space between said engine housing and said casing at a same or closely adjacent location whereat said cooling air from cooling said engine enters said outlet opening to thereby permit all of said cooling air to flow outwardly through said outlet opening of said casing, said engine housing being disposed between said openings in said intermediate walls and said inlet opening of said casing, said engine housing being located downstream of said inlet opening and upstream of said openings in said intermediate walls.

* * * * *